US007611755B2

(12) United States Patent
Kellie et al.

(10) Patent No.: US 7,611,755 B2
(45) Date of Patent: Nov. 3, 2009

(54) ELECTROPHORETIC STYLUS ARRAY PRINTING WITH LIQUID INK

(75) Inventors: Truman Frank Kellie, Lakeland, MN (US); William D. Edwards, New Richmond, WI (US)

(73) Assignee: Samsung Electronics Co., Ltd., Suwon-si (KR)

( * ) Notice: Subject to any disclaimer, the term of this patent is extended or adjusted under 35 U.S.C. 154(b) by 461 days.

(21) Appl. No.: 11/022,372

(22) Filed: Dec. 23, 2004

(65) Prior Publication Data

US 2006/0137557 A1 Jun. 29, 2006

(51) Int. Cl.
*B05D 1/04* (2006.01)

(52) U.S. Cl. ..... 427/466; 427/483

(58) Field of Classification Search ..... None
See application file for complete search history.

(56) References Cited

U.S. PATENT DOCUMENTS

| | | | | |
|---|---|---|---|---|
| 2,932,690 | A * | 4/1960 | William et al. | 358/300 |
| 3,950,760 | A | 4/1976 | Rauch et al. | 347/68 |
| 4,258,371 | A * | 3/1981 | Sekine et al. | 347/40 |
| 4,401,024 | A * | 8/1983 | Frentress | 101/93.01 |
| 4,406,603 | A | 9/1983 | Williams | 425/191 |
| 4,525,727 | A | 6/1985 | Kohashi et al. | 347/13 |
| 4,630,074 | A | 12/1986 | Horinouchi et al. | 346/139 C |
| 5,663,024 | A | 9/1997 | Smith et al. | 430/97 |
| 5,753,763 | A | 5/1998 | Rao et al. | 525/276 |
| 5,847,733 | A | 12/1998 | Bern | 347/55 |
| 5,935,755 | A * | 8/1999 | Kazmaier et al. | 430/123.5 |
| 6,008,627 | A | 12/1999 | Narita | 320/134 |
| 6,388,693 | B1 | 5/2002 | Loos | 347/214 |
| 6,785,495 | B2 | 8/2004 | Baker et al. | 399/249 |
| 6,806,013 | B2 | 10/2004 | Morrison et al. | 430/114 |
| 6,815,132 | B2 | 11/2004 | Zhu et al. | 430/58.45 |
| 6,828,358 | B2 | 12/2004 | Morrison et al. | 523/160 |

* cited by examiner

*Primary Examiner*—Frederick J Parker
(74) *Attorney, Agent, or Firm*—DLA Piper LLP US

(57) ABSTRACT

A process and apparatus prints images. The process provides an imaging surface; an array of styli opposed to the imaging surface; and a flow of liquid ink containing charged ink particles in the ink between the imaging surface and the array of styli. A voltage bias is established between at least one stylus in the array of styli and the imaging surface. The voltage bias plates at least some charged ink particles onto the imaging surface in response to the voltage bias.

14 Claims, 3 Drawing Sheets

PRIOR ART

ELECTROPHORETIC STYLUS ARRAY PRINTING WITH LIQUID INK

BACKGROUND OF THE INVENTION

1. Field of the Invention

The present invention relates to the field of imaging, graphic imaging, print imaging, liquid ink imaging and the like. The technology is more narrowly applicable to digital imaging, particularly black-and-white or multi-color imaging.

2. Background of the Art

There are many different formats of imaging and particularly printed imaging available in commercial practice and theoretic investigation. The original forms of printing were by the physical application (by hand, stick or brush) of inks or paints to surfaces in a desired pattern or image. It wasn't until brief centuries ago that mechanical imaging came into existence, first by woodcutting a relief, applying inks to the relief image and then transferring the ink from the relief to a receiving surface by physical contact of the relief and the surface. In the Fifteenth Century, moveable type was first constructed, using the individual type settings to form a relief image for press printing of images.

A common form of personal and commercial imaging available today falls within the generic class of electrography, which includes electrophotography. In these systems, by various means, an imagewise distribution of electrostatic charges (a latent image) is formed on an image receiving surface, and an ink or toner is presented in the vicinity of the surface. At least one visible, image-forming component of the ink or toner is differentially attractive to the image receiving surface based upon the charge distribution, and an intermediate or final image is formed upon stabilization (e.g., adhesion, fusion, drying, transfer, etc.) of the deposited image onto a surface. Various background descriptions of electrophotography and particular aspects thereof are disclosed, by way of non-limiting examples, in U.S. Pat. Nos. 6,828,358; 6,815,132; 6,806,013; 6,785,495; 6,696,209; and 6,670,085, which patents are incorporated herein by reference in their entirety.

There are many different ways of forming a latent image that can be subsequently treated to provide a visible image. The various technologies for forming latent images that are toned (as opposed to latent images that are developed from materials and composition that create and store the latent image, as in photography, thermography, photothermography, diazotype and the like) may, by way of non-limiting examples, include charge application by styli, charge application by physical transfer of charges, and charge distribution formed by selective discharging to leave a distribution of residual charge. The last process is most common in the electrophotographic process. A highly simplified description of electrophotography is that a charge is (uniformly) distributed over a surface, the charged surface is exposed to a distribution of radiation (usually visible light, infrared radiation and/or UV radiation, hereinafter generally referred to as "light"), the light instigates a change in local electrical conductivity, and charge is locally carried away because of the local changes in conductivity. By removing charge is areas struck by light, a latent image of charge remains on the surface in areas that are not struck by light. This latent image is then exposed to toner or ink (usually under a biasing voltage to provide mass transfer forces for the ink or toner components) to develop the latent image, either in a positive sense or a negative sense with respect to the latent image.

U.S. Pat. No. 6,388,693 (Loos) describes an apparatus for printing graphic images on sheet material comprising a print head, such as a thermal print head having a linear array of heating elements, which is pressed into engagement with an ink web overlying the sheet material on a platen. The platen may be, for example, a roller platen which is rotatably driven to in turn drive the sheet material with the ink web relative to the print head. A removable cassette having a predetermined length L of ink web bearing a printing ink is mounted adjacent to the print head with the ink web interposed between the sheet material and the print head for printing the graphic images on the sheet. A supply spool carrying the ink web is rotatably mounted within the cassette, and a take-up spool is also rotatably mounted within the cassette for receiving the ink web from the supply spool upon passage between the platen and print head. The take-up spool defines a first overall diameter D1 without receiving the ink web from the supply spool, and a greater second overall diameter D2 upon receiving the predetermined length L of ink web, wherein the second overall diameter D2 is within approximately 10% of the first overall diameter D1. The apparatus further comprises means for applying a constant torque to the take-up spool, preferably a spring-wrapped clutch, to thereby maintain a substantially constant tension within the ink web during printing operations.

U.S. Pat. No. 5,847,733 (Bern) describes an image recording apparatus in which charged particles are deposited in an image configuration on an information carrier. The method includes conveying the charged particles to a particle source adjacent to a back electrode; positioning a particle receiving information carrier between the back electrode and the particle source; providing a control array of control electrodes; providing at least one set of deflection electrodes; creating an electric potential difference between the back electrode and the particle source to apply an attractive force on the charged particles; connecting variable voltage sources to the control electrodes to produce a pattern of electrostatic fields to at least partially open or close passages in each electrostatic field by influencing the attractive force from the back electrode, thus permitting or restricting the transport of charged particles towards the information carrier; and connecting at least one deflection voltage source to at least one set of deflection electrodes to produce deflection forces modifying the symmetry of the electrostatic fields, thus controlling the trajectory of attracted charged particles.

U.S. Pat. No. 4,630,074 (Hironouchi et al.) describes an electrode for discharge printing in accordance with an applied electrical signal comprising: (a) a multiple-stylus electrode body formed of an insulating material consisting mainly of a resin having a thermal deforming temperature at least 200° C.; and (b) several electrode elements each composed of an elongate core of a high melting point material coated with a borosiloxane resin, wherein the electrode elements are arranged in a parallel array and each has a first end moulded within said electrode body, and a second end projecting from said electrode body and laterally spaced from the second ends of the other electrode elements.

U.S. Pat. No. 4,525,727 (Kohashi) describes an electroosmotic ink printer comprising a head having an array of recording electrodes successively arranged to define a print line along one edge of the head. A common electrode is provided in spaced overlying relation with the recording electrodes. Between the electrode array and the common electrode is a means for electroosmotically moving ink in a direction toward the print line and in an opposite direction depending on an electrical potential applied to the recording electrodes with respect to the common electrode. A memory stores a video input signal in a plurality of storage locations corresponding to the recording electrodes for delivery in parallel form to a modulator for generating individual recording signals corresponding to the recording electrodes. Control means activates first and second groups of the recording electrodes by successively applying the individual recording signals thereto to cause the ink to move to the print line and deactivates the remainder of the recording electrodes by successively applying a deactivating potential to the electrodes of the group other than those to which the recording signals are applied.

U.S. Pat. No. 3,950,760 (Rausch) teaches a device for writing with liquid ink in which the transfer of the ink to the record carrier is electrically controlled. The device comprises an elongated flexible beam having a major axis extending in the direction of elongation. The beam includes a piezoelectric element and electrodes. The element is made of a piezoelectric material having at least two regions oppositely polarized. The regions are disposed to bend the beam in a direction transverse to the major axis of the beam responsive to an associated electric potential applied to the electrodes. The beam further includes electrodes disposed on the surface of the element. The element includes walls defining a plurality of ducts which extend in the longitudinal direction of the beam. The device includes a writing stylus secured to the end face of the beam. The stylus includes means for conveying liquid ink, the means being in fluid communication with at least one of the ducts.

U.S. Pat. No. 4,406,603 (Goffe) describes an apparatus for applying a charge pattern to an insulating imaging member by a stylus array of the type wherein the styli of the array are in direct contact with the insulating imaging member, and the insulating imaging member and the styli move relatively with respect to each other, the improvement comprising: an adjustable stylus array having each stylus in the array resiliently held into contact with the insulating imaging member; means for applying a signal voltage to the styli in said array for production of a charge pattern on the insulating imaging member; and means for adjusting said stylus array to obtain a force of contact between the styli in the array and the insulating imaging member that is below the force of contact necessary to develop a triboelectric charge on the insulating imaging member because of the rubbing contact with the styli during relative movement between the styli and the insulating imaging member, so that there will be substantially no background charge on the insulating imaging member.

Other electrographic systems with stylus-generated latent images include, by way of non-limiting examples, U.S. Pat. Nos. 5,663,024; 5,732,311; 5,753,763; and 6,008,627.

These systems are capable of providing high quality images, but a concern with many of the electrophotographic systems is a lack of speed because of the need for raster scanning of the image by collimated radiation (e.g., a laser) to effect the distribution of discharged areas on the surface where toner or ink is to be deposited. This step is inherently a rate controlling step in the process as it is a physical step where the collimated radiation covers only a small area (the laser spot), and that spot must be physically moved over the entire image surface, one spot at a time to construct pixels on the surface. Any process that could further speed up a toned imaging process would be desirable.

SUMMARY OF THE INVENTION

A toned or inked imaging process, apparatus and system is provided. The process operates by providing an array of voltage styli over a surface to be imaged, with a gap between the styli and the surface. While toner particles supported in a fluid medium (e.g., liquid toner or ink, and solid toner in a supportive gas phase) passes between the styli and the surface, a voltage differential is established between the styli and the surface, the differential driving particles/material (from the toner or ink that are to be deposited to form an image) to the surface. These particles are at least temporarily retained on the surface in a pattern of distribution that corresponds to the pattern of voltage applied by the styli. As voltages can be applied from an array, with an entire array (either one-dimensional pattern as a single line of styli, or as two-dimensional pattern as multiple lines of styli), there is less of a rate controlling limiting from the imaging process than there is in an electrophotographic imaging process where usually only a single spot at a time in a single line is part of the image-forming (discharging) step.

The process behaves as an electrophoretic imaging process, with materials being deposited from the carrying medium (fluid medium) without formation of a latent image at one physical location in the process and deposition of image-forming material (from toner or ink) at a subsequent location.

DETAILED DESCRIPTION OF THE INVENTION

Figure 3B:
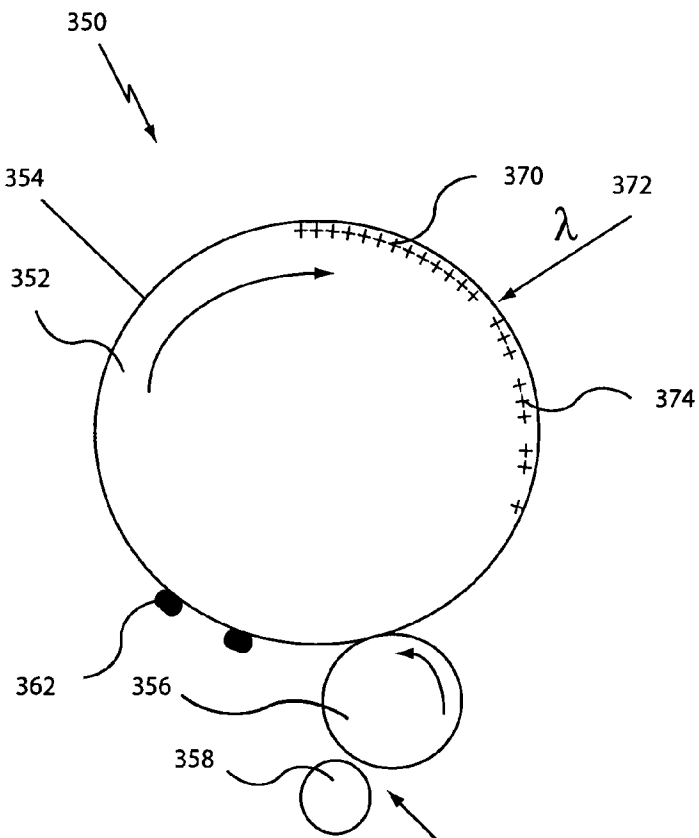
FIG. 3B shows a prior art contact delivery electrophotographic system.
Figure 3A:
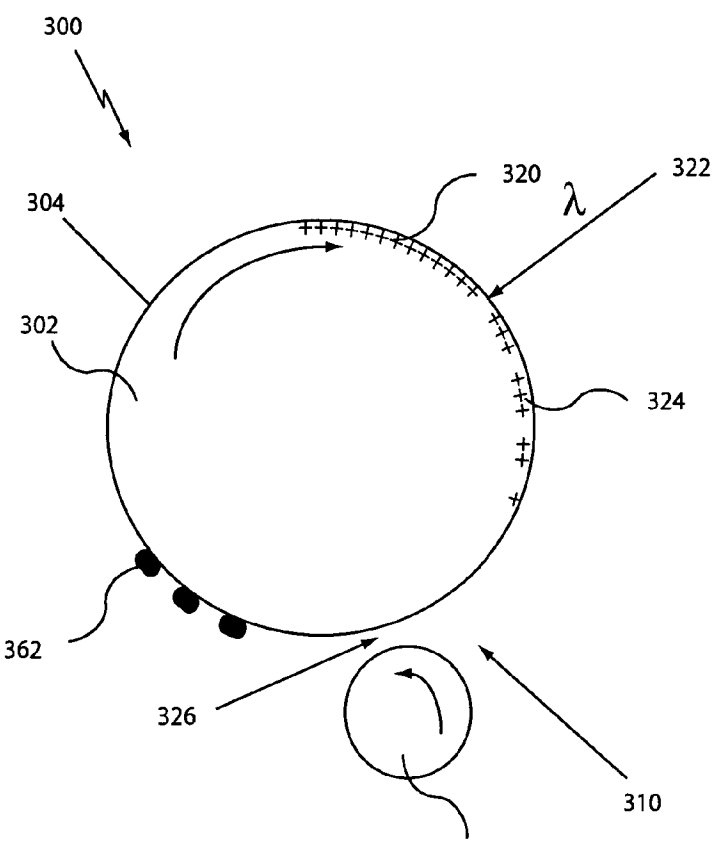
FIG. 3A shows a prior art gap delivery electrophotographic system.

Two general prior art systems for conventional electrophotography comprise gap development and contact development, as shown in FIGS. 3A and 3B, respectively. In these electrophotographic systems, 300 (gap development) and 350 (contact development) there are rollers 302 and 352 carrying organic photoconductive surface layers 304 and 354 and liquid ink flow areas 310 and 360. Essentially continuous surface charging 320 and 370 is provided on the rollers 302 and 352, and then imaging radiation 322 and 372 causes discharging and forms the latent image 324 and 374 of distributed charges on the photoconductor layer 304 and 354. In the gap development system of FIG. 3A, a voltage bias is maintained across gap 326 between the roller 302 and the bias roller 306. An image 362 is formed by developer/ink from the ink flow 310 being plated onto the latent image 324 being driven by the bias across the gap 326. In the contact development system of FIG. 3B, the liquid ink flow is between a biased deposit roller 358 and a contact roller 356, the bias assuring uniform coating of the contact roller 356. The contact roller 356 then carries ink to the latent image 374 on the surface 354 of the roller 352 and deposits the ink onto the latent image 374 forming the visible image 362 on the roller 302. As can be readily seen from this description, an organic photoconductive system is needed, a radiation imaging system is needed, formation of a latent image is needed, and the latent image must be transported to a toning, plating or inking site to form a visible image. Each of these requirements necessitates significant technical expertise in the complexities of organic photoconductors, optical imaging, and mass transfer.

According to teachings provided herein, an imaging process in which image forming materials are deposited onto a surface is provided in a printing-type format. Image forming materials (e.g., particles comprising materials with visible radiation, UV radiation or IR radiation optical density) are carried in a fluid medium between a stylus array and an imaging surface (herein generally referred to as a "roller" as rollers are typically used in most printer imaging processes, although a flat bed surface may be used). As a voltage bias is established between individual styli and the surface of the imaging roller, particles are driven by the electrostatic forces onto the surface of the imaging roller. This is a fundamentally different system than other electrostatic imaging systems, and particularly electrophotographic imaging systems that require a latent image to be formed by exposure to focused radiation. This system does not require or need any photoconductive layers or radiation imaging systems.

In the electrographic art, as noted above, an imaging surface (whether a final image surface or an intermediate surface) is provided with an image-wise distributed charge that constitutes a latent image. In a step that is clearly subsequent in time, toner or ink is provided in such a manner that the toner or ink is allowed to deposit on the imaging surface in a pattern consistent with the latent image formed by the pre-existing charge. The charging and/or formation of the charge distribution is performed earlier in time and often earlier in a path of physical movement of the imaging surface than is the development step where visible image density is provided to the latent image.

In the practice of the present technology, there is no prior latent image formed as described herein.

Figure 1:
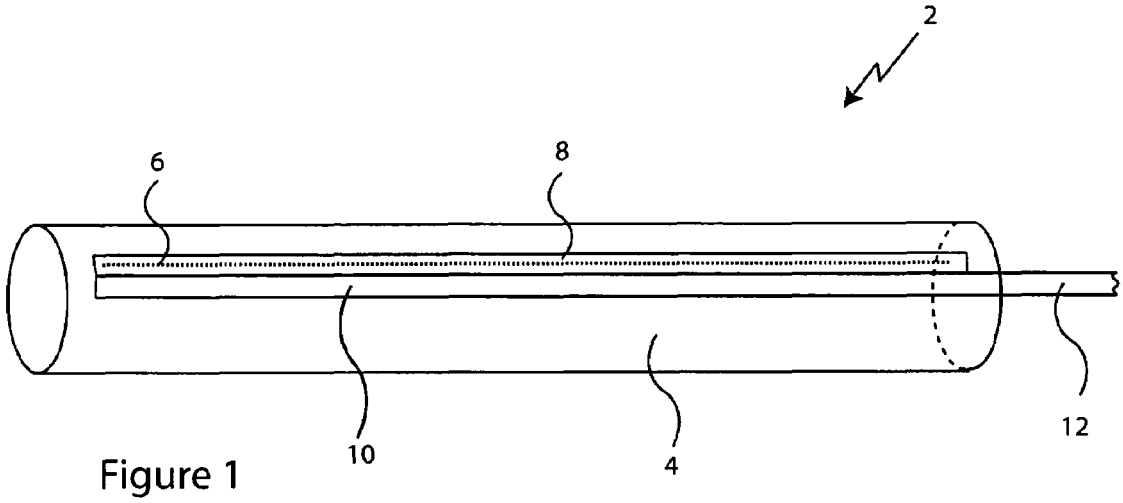
FIG. 1 shows a perspective view of a stylus array support for use in imaging processes.
Figure 2:
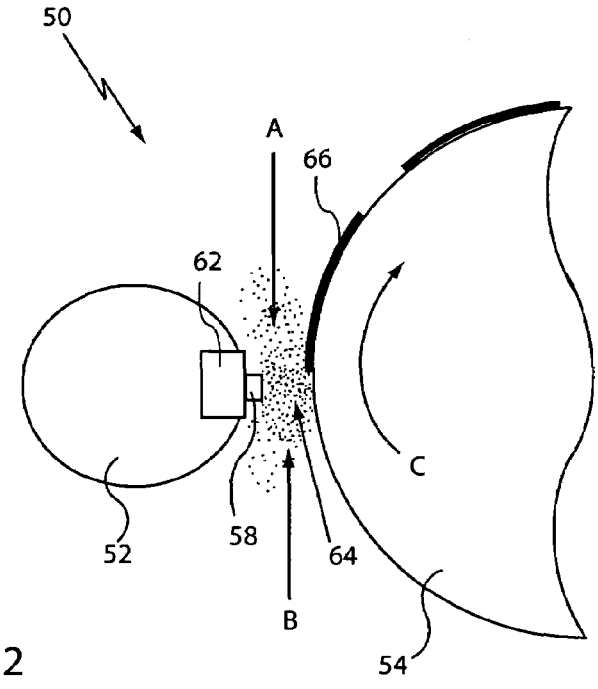
FIG. 2 shows an example of a schematic cutaway, side view of a stylus array support and imaging roller for use in systems and methods according to teachings provided herein.

A general background to the electrophoretic process described herein can be further understood by reference to FIGS. 1 and 2. FIG. 1 shows a stylus delivery element 2 comprising a structural support 4, a stylus array 8, and a stylus electrical contact strip 10, and an electrical/information feed 12. The stylus array 8 has at least one line of styli 6 (and multiple lines are desirable, but not shown for convenience and simplicity of the figure). The contact strip 10 has individual electrical connections (not shown) to each stylus 6, and signals and power are sent through the feed 12. The signals and power cause the individual styli 6 to provide a voltage used in creating the bias necessary for the electrophoretic plating of toner particles from an ink onto a receptor surface. The styli 6 are located, arranged or disposed on or through the structural support 4.

FIG. 2 shows a more complete end view schematic of an electrophoretic stylus array imaging system 50 according to teachings provided herein. A stylus support element 52 is shown with a stylus 58 and an electrical/information feed 62 in electrical contact with the stylus 58. A receptor imaging roller 54 is shown in opposition to the stylus 58. The roller 54 is shown rotating in a clockwise direction C, but rotation in a counterclockwise direction is also possible. The outer surface of the roller 54 may be uniformly charged or uncharged. Between the roller 54 and the stylus 54 an electrostatic ink 64 is provided. The ink should be maintained in a state of flow (in either direction a or B) to keep the ink 64 replenished. With clockwise rotation C, directional flow B may be preferred. As a voltage is applied (for microsecond intervals) by the stylus 58, particles are responsively plated as a particle imaging component 66 on the roller 54. The applied voltage must be greater than any residual voltage on the roller 54 so that a biasing voltage of sufficient strength is provided to assure accurate plating of the imaging component 66 on the roller 54.

The application of a voltage bias across a gap between a stylus and an imaging surface drives particles suspended in a fluid medium onto the imaging surface in the voltage filed established between a stylus and the imaging surface. Each stylus may be independently activated to provide the voltage creating the bias. The bias is established in the presence of the fluid medium containing the imaging material to be deposited. Those imaging materials may be the standard imaging components of electrographic and electrophotographic inks and toners, without any fundamental modification. These imaging materials ordinarily comprise at least a binder and a dye or pigment. The material is usually designed to have a built-in charge director (a component with an appropriate charge to assist in responding to biasing voltage) to assist in the directed movement or plating of particles onto the imaging surface. Off-the-shelf commercial liquid toners have proven to work well in the system, without any modification.

The voltage is established and removed by an electrical control system that connects a controllable voltage source to each stylus. As the styli move in relation to the imaging surface, the voltage on each stylus along the entire line or lines of styli is controlled to provide voltage bias in a distributed pattern across the fluid carrier supporting the imaging material. The carrier and imaging material (which may be referred to as a toner or ink, as commercial compositions of these materials are used) should steadily flow between the styli and the imaging surface to maintain a sufficient supply of plateable or depositable imaging material (particles) without significant concentration variation. This can be done by providing laminar flow of liquid toner between the styli and the imaging surface. In small scale desk-top prototypes, the use of an eye-dropper to place toner between the styli and imaging surface was sufficient to produce images of individual colors and well defined dots formed by the stylus array. Only on a purely theoretic basis can there be a latent image considered in the practice of the technology, as the particles are moved at the same time that the voltage differential (the biasing voltage) is being established. There is at most, a contemporaneous establishment of a local field (biasing voltage) and particle deposition. There is never a stable, persistent (in relative electronic terms) non-visible image that can be later provided with visible image material.

By controlling the distribution of the styli in the stylus array, printing resolution of 600 dots per inch (dpi) can be provided with three arrays of 200 dpi capability on each array. With this configuration and commercially available components, satisfactory writing speeds of up to 10.3 cm/second have been achieved. That speed is not even a limit that can be expected with further optimization of components and materials.

Figure 4:
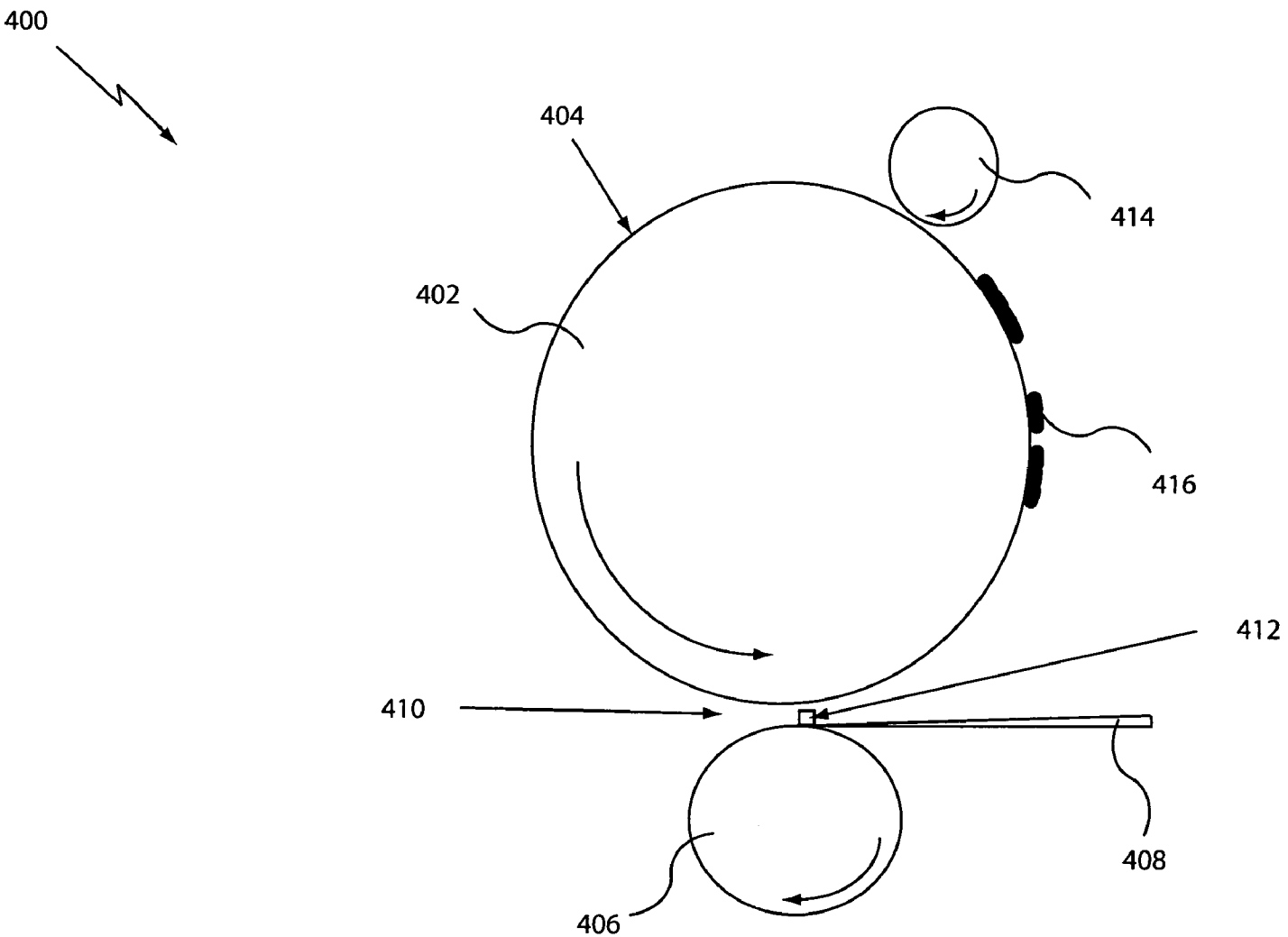
FIG. 4 shows one embodiment of a stylus array electrophoresis delivery system as described herein.

Another construction according to these teachings is shown in FIG. 4 a roller 402 (which could also be a flatbed printing surface) is provided with an ink delivery roller 406 which assists in keeping the liquid ink flow 410 moving across the surface 404 of the imaging roller 402 between the ink delivery roller 406 and the roller 402. A stylus array 412 is provided on a support 408 (here shown as a support blade) that is connected to an electronic data and power supply (not shown). The array is provided with the imagewise distributed voltage (e.g., a voltage bias of at least 100V (preferably at least 200 V, at least 250V, at least 350V, at least 450V, at least 500V or more) is provided between the stylus array 412 and the surface 404 of the imaging roller 402. The voltage bias (e.g., the roller may have some charge or voltage applied thereto or retained therein, but the styli that have a voltage applied thereto have a higher voltage than the imaging roller 402) causes particles in the liquid ink flow 410 to deposit or plate onto the surface 404 of the imaging roller 402 to form the image 416. The image 416 may then optionally be subjected to a squeegee roller 414 to assist in removing carrier liquid before drying or curing. This apparatus and process eliminates optical imaging, photoconductor materials, and the like. The roller 402 surface 404 need only be durable, adsorb ink, and have a controlled degree of resistance and conductivity to support and temporarily maintain the image and subsequently transfer it to a receiver sheet or intermediate transfer element.

The described technology enables a process for the printing of images comprising: providing an imaging surface; providing an array of styli opposed to the imaging surface; providing a flow of liquid ink containing charged ink particles in the ink; providing a voltage bias between at least one stylus in the array of styli and the imaging surface; and plating at least some charged ink particles onto the imaging surface in response to the voltage bias. The plating is conveniently described as spraying, as the voltage bias can sometimes cause a movement of particles suspended in the liquid ink to move in a manner that resembles spraying. In the practice of the method, it is convenient to establish a voltage bias of at least 50V or at least 100V between the at least one stylus and the imaging surface. A preferred imaging surface is a roller. The roller does not have to have a photoconductor thereon, but in construction of rollers for the presently described technology, rollers with and without photoconductor materials can be used, but the photoconductor is unnecessary in the practice of the process. The voltage bias is maintained for a period of time sufficient to provide movement and plating of particles, which can be conveniently less than 2,000, less than 100, and less than or equal to 500 microseconds. In practice, the voltage can be established and reduced (to a non-plating level) in this time frame. As noted, the imaging roller has an exterior surface and the exterior surface can be free of photoconductor material. It is desirable to maintain the flow of liquid ink as laminar flow between the stylus array and the imaging roller. The imaging roller may be a cylinder having a length parallel to a central axis of the cylinder and the stylus array should cover more than 50% of the length of the cylinder, and may cover the entire imaging dimension of the imaging surface. This could theoretically be 100% of the length, but some non-imaging edge is ordinarily provided in imaging apparatus. A good commercial standard for operation of the method is for the bias voltage to be established and discharged in less that 1000 milliseconds.

An apparatus for providing a printed electrostatic image according to the teachings herein may comprise: an imaging surface; an array of styli that can be provided with a voltage; and a supply of liquid ink that supplies liquid ink between the array and the imaging surface while the array of styli are provided with a voltage and then the voltage reduced. The imaging surface may be free of photoconductor material and the styli do not contact the imaging surface. The presence of the photoconductor would be superfluous. The array of styli may extend in a line covering at least 50% of a greatest length on the imaging surface (e.g., the length parallel to the cylinder axis, as described above for an imaging roller). The array may comprise multiple lines of styli. Each stylus in the array of styli can be independently provided with a predetermined voltage to control the dots provided in the image on the imaging surface. In the apparatus, the supply of liquid ink provides a flow of liquid ink containing charged particles between the imaging surface and the array of styli. The imaging roller may turn continuously as the voltage bias is established and reduced, and the roller does not have to be stopped during voltage bias establishment and reduction. The array of styli may be fixed relative to an initial position of the imaging surface and the imaging surface is moveable. That is, the array does not move within the apparatus, but the imaging surface moves relative to the arrays.

What is claimed:

1. A process for the printing of images comprising:

providing a roller having a surface;

providing an array of styli opposed to the surface;

providing a flow of liquid ink containing charged ink particles between the array of styli and the surface;

providing voltage to the styli creating a voltage bias between at least one stylus in the array of styli and the surface; and plating at least some charged ink particles onto the surface in response to the voltage bias;

wherein the providing the voltage bias step and the plating step are performed substantially contemporaneous, wherein the voltage applied to the styli is greater than any residual voltage of the roller.

2. The process of claim 1, wherein the ink particles are retained on the surface in a pattern of distribution that corresponds to a pattern of voltage supplied by the styli.

3. The process of claim 1, wherein the voltage bias between the at least one stylus and the surface of the roller is at least 100V.

4. The process of claim 1, wherein the voltage bias is maintained for a period of time less than about 2,000 microseconds.

5. The process of claim 1, wherein the voltage bias is maintained for a period of time less than 1,000 microseconds.

6. The process of claim 1, wherein the voltage bias is maintained for a period of time less than or equal to about 500 microseconds.

7. The process of claim 1, wherein the surface is substantially free of photoconductor material.

8. The process of claim 1, wherein the roller is a cylinder having a length parallel to a central axis of the cylinder and the stylus array covers more than 50% of the length of the cylinder.

9. The process of claim 1, wherein the voltage bias is established and discharged in less than about 1000 milliseconds.

10. The process of claim 1, wherein the providing of a flow of liquid ink containing charged ink particles occurs between the array of styli and the surface at a first physical location without formation of a latent image at the first physical location and without deposition of image-forming material at a subsequent location.

11. The process of claim 1, wherein the voltage is provided to only the styli.

12. The process of claim 11, further comprising providing data to the styli, the data causing the ink to plate in a desired image onto the surface.

13. The process of claim 1, wherein the ink flow provided is substantially perpendicular to the arrangement of the styli.

14. The process of claim 1, further comprising providing a gap between the surface and the styli.

* * * * *